US010894637B2

(12) United States Patent
Enomoto et al.

(10) Patent No.: US 10,894,637 B2
(45) Date of Patent: Jan. 19, 2021

(54) PLUGGING-TYPE RESIN CAP

(71) Applicant: Nippon Closures Co., Ltd., Tokyo (JP)

(72) Inventors: Katsumi Enomoto, Tokyo (JP); Koshin Ri, Tokyo (JP); Sei Nakagawa, Tokyo (JP); Katsumi Hashimoto, Tokyo (JP)

(73) Assignee: NIPPON CLOSURES CO., LTD., Tokyo (JP)

( * ) Notice: Subject to any disclaimer, the term of this patent is extended or adjusted under 35 U.S.C. 154(b) by 414 days.

(21) Appl. No.: 16/037,207

(22) Filed: Jul. 17, 2018

(65) Prior Publication Data

US 2018/0319553 A1 Nov. 8, 2018

Related U.S. Application Data

(63) Continuation of application No. PCT/JP2017/001561, filed on Jan. 18, 2017.

(30) Foreign Application Priority Data

Jan. 20, 2016 (JP) ..... 2016-009166
Jan. 28, 2016 (JP) ..... 2016-014687

(51) Int. Cl.
*B65D 45/32* (2006.01)
*B65D 55/08* (2006.01)
(Continued)

(52) U.S. Cl.
CPC ..... *B65D 45/322* (2013.01); *B65D 41/185* (2013.01); *B65D 41/28* (2013.01);
(Continued)

(58) Field of Classification Search
CPC ..... B65D 45/322; B65D 41/185; B65D 41/42
(Continued)

(56) References Cited

U.S. PATENT DOCUMENTS 3,866,782 A * 2/1975 Westfall ..... B65D 55/0863 215/253
4,328,906 A * 5/1982 Walter ..... B65D 47/141 220/260
(Continued)

FOREIGN PATENT DOCUMENTS

DE 1 121 494 B 1/1962
FR 2 429 716 A1 1/1980
(Continued)

OTHER PUBLICATIONS

International Search Report dated Apr. 4, 2017, issued in counterpart International Application No. PCT/JP2017/001561 (2 pages).

*Primary Examiner* — J. Gregory Pickett
*Assistant Examiner* — Tia Cox
(74) *Attorney, Agent, or Firm* — Westerman, Hattori, Daniels & Adrian, LLP

(57) ABSTRACT

Provided is a plugging-type resin cap which can sufficiently seal a container and in which, upon uncapping of the container, a restraining band loosens after the pressure in the container is released without the application of an excessive force. A plugging-type resin cap (100) includes a restraining band (130), a tab (140), and engagement projections (151). The restraining band (130) has an arcuate restraining portion (131), stoppers (132), and an upwardly projecting portion (133). The stoppers (132) are formed to extend radially outward from the circumferential both ends of the restraining portion (131). The engagement projections (151) are disposed over an outer side surface of a skirt wall (120) in the vicinity of the circumferential both ends of a tab (140). The stoppers (132) and the engagement projections (151) are formed to be fittable with each other.

14 Claims, 14 Drawing Sheets

(51) Int. Cl.

| | |
|---|---|
| ***B65D 41/32*** | (2006.01) |
| ***B65D 55/16*** | (2006.01) |
| ***B65D 41/48*** | (2006.01) |
| ***B65D 41/18*** | (2006.01) |
| ***B65D 41/28*** | (2006.01) |

(52) U.S. Cl.
CPC ..... *B65D 41/32* (2013.01); *B65D 41/48* (2013.01); *B65D 41/485* (2013.01); *B65D 45/32* (2013.01); *B65D 55/0863* (2013.01); *B65D 55/16* (2013.01)

(58) Field of Classification Search
USPC ..... 215/255, 274, 228, 275, 273; 220/319–321, 315
See application file for complete search history.

(56) References Cited

U.S. PATENT DOCUMENTS

| | | | | |
|---|---|---|---|---|
| 10,214,324 | B2 * | 2/2019 | Shimada | B65D 45/322 |
| 2017/0305612 | A1 * | 10/2017 | Shimada | B65D 55/12 |

FOREIGN PATENT DOCUMENTS

| | | | |
|---|---|---|---|
| GB | 1 442 433 | A | 7/1976 |
| JP | 51-92277 | A | 8/1976 |
| JP | 2011-219111 | A | 11/2011 |
| JP | 2012-201399 | A | 10/2012 |
| JP | 2015-182810 | A | 10/2015 |
| WO | 2016/063641 | A1 | 4/2016 |

* cited by examiner

ENLARGED VIEW OF PORTION A

PLUGGING-TYPE RESIN CAP

TECHNICAL FIELD

The present invention relates to a plugging-type resin cap which is placed over the mouth portion of a container, such as a jar or a plastic bottle, and pressed down to be attached to the mouth portion.

BACKGROUND ART

Conventionally, as a cap to be attached to the mouth portion of a container such as a jar, a metal cap provided with a resin tab having a ring-shaped hold portion into which a finger can be inserted has been known. In the metal cap, a score is provided to extend from a side surface to a top surface. When the container is uncapped, the tab is pulled up with the finger inserted in the hold portion to tear a portion of the metal cap along the score. By further pulling up the tab, the metal cap is detached from the mouth portion of the container, so that the uncapping is completed. When the content of the container is a carbonated beverage or the like, upon tearing of the portion of the metal cap, the internal pressure of the container is safely released without entailing detachment of the metal cap from the mouth portion of the container. This is also effective even with a product in which a container contains a highly carbonated beverage or the like and has a higher internal pressure.

However, a metal cap involves the risk that a metal piece torn off upon uncapping of the container may cut a finger or the like. In addition, since metal caps have to foe inconveniently separated front resin tabs when discarded, the recent years has seen the filing of a patent application for a plugging-type resin cap using a resin as a replacement for a metal cap.

For example, a known plugging-type resin cap in Patent Literature 1 or the like has a cap top surface and a skirt wall extending vertically downward from the circumferential edge of the cap top surface. The skirt wall has an engagement rib formed along the inner side surface thereof and further has an annular restraining band and a tab which are provided via a breakable portion. At the outer surface of the skirt wall, easily breakable portions are provided in the vicinity of the circumferential both ends of a tab main body.

The tab has a hold portion for allowing a finger or the like to be inserted therein and the tab main foody formed to extend radially outward from the outer side surface of the skirt wall.

When the plugging-type resin cap is placed over the mouth portion of a container and the cap top surface is pressed down, the upper surface of the mouth portion of the container and the lower side of the cap top surface come into contact with each other to bring the engagement rib into close contact with the outer side surface of the mouth portion of the container. By subsequently moving the restraining band downward, the breakable portion is broken to allow the restraining band to peripherally tighten the skirt wall, so that the capping of the container is completed.

On the other hand, when the container is uncapped, the hold portion of the tab is lifted up with the finger inserted therein to lift up the restraining band, while tearing the easily breakable portions of the skirt wall. By further lifting up the bold portion, the tightening of the plugging-type resin cap is removed, and the plugging-type resin cap is detached from the mouth portion of the container in such a manner as to be peeled up starting at the tab, so that the uncapping of the container is completed.

CITATION LIST

Patent Literature

Patent Literature 1: Japanese Patent Application Publication No. 2012-201399

SUMMARY OF INVENTION

Technical Problem

However, in the plugging-type resin cap in Patent Literature 1, when the container is uncapped, the hold portion of the tab is lifted up with the finger inserted therein to lift up the restraining band, while tearing the easily breakable portions of the skirt wall. As a result, when the container is internally pressurized by a carbonated beverage or the like, the removal of the tightening of the plugging-type resin cap by the restraining band is performed before or simultaneously with the release of the internal pressure. The internal pressure of the container may cause sudden detachment of the plugging-type resin cap from the mouth portion of the container, and instantaneous release of the internal pressure may cause the liquid in the container to splatter to the outside of the container and contaminate the surroundings.

In addition, since the ring-shaped restraining band firmly tightens the skirt wall and the hold portion needs to fee forcefully lifted up when the tightening is removed, when an excessively force is applied, the plugging-type resin cap or the container held by a hand may accidentally drop therefrom at the moment when the restraining band is detached.

Moreover, since the breakable portion connecting the restraining band and the skirt wall is broken upon uncapping of the container, the restraining band becomes an independent part. As a result, the restraining band may unintentionally be detached upon uncapping of the container to increase the number of the parts to be discarded.

The present invention is intended to solve such problems, and an object of the present invention is to provide a plugging-type resin cap which can sufficiently seal a container even for a product in which the container contains a highly carbonated beverage or the like and has an extremely high internal pressure and which allows the container to be uncapped without requiring the application of an excessive force upon uncapping of the container. When the container is uncapped, the plugging-type resin cap is not suddenly detached from the mouth portion of the container due to the internal pressure of the container, and the liquid in the container does not splatter to the outside of the container. After the internal pressure is released front the container, the restraining band loosens to allow the cap to be safely removed from the mouth portion of the container without increasing inconvenience at the time of disposal.

Solution to Problem

A plugging-type resin cap of the present, invention, which solves the foregoing problems, includes: a cap top surface; a skirt wall extending vertically downward from a circumferential edge of the cap top surface; an engagement rib formed along an inner side surface of the skirt wall; and a restraining band tightening the skirt wall, and further includes a tab, and engagement projections. The restraining band has an arcuate restraining portion, stoppers, and an upwardly projecting portion. The stoppers are formed to extend radially outward from circumferential both ends of the restraining portion. The upwardly projecting portion has two projecting pieces formed to extend upward from the circumferential both ends of the restraining portion and a joint joining the two projecting pieces together. The tab has a tab main body formed over an outer side surface of the skirt wall and a hold portion provided under the tab main body. The engagement projections are provided over the outer side surface of the skirt wall to be separate from the tab main body. The stoppers and the engagement projections are fit with each other.

Advantageous Effects of Invention

In the plugging-type resin cap according to claim 1, the stoppers are formed at the circumferential both ends of the arcuate restraining portion. As a result of the interfitting between the stoppers and the engagement projections, the restraining band tightens the skirt wall. Thus, the length of the restraining portion is reduced to enhance the tightening force applied to the skirt wall and allow the container to be sufficiently sealed.

Even when the length of the restraining portion is reduced, the restraining portion can vertically move without interfering with the skirt wall before the stoppers and the engagement projections fit with each other.

Since the restraining band is formed of the restraining portion and the upwardly projecting portion into the ring shape, a shift in the positional relationship between the circumferential both ends of the restraining portion and the degree of opening of the restraining portion are prevented from being extremely increased. This allows the operation of fitting the stoppers and the engagement projections with each other to be easily performed.

In addition, the tab main body and the engagement projections are discretely formed over the skirt wall to be separate from each other, and the upwardly projecting portion is further provided thereabove so as to prevent the tab main body from easily coming into contact with the joint. Accordingly, after a gap is formed by lifting up the tab and thus distorting a portion of a sealing surface between the plugginq-type resin cap and the mouth portion of the container, the tab main body comes into contact with the joint of the upwardly projecting portion from therebelow to lift up the restraining band. Thus, after the internal pressure of the container is released, the tightening of the skirt wall by the restraining band is removed. As result, it is possible to uncap the container without applying an excessive force and, when the container is uncapped, the plugging-type resin cap is prevented from being suddenly detached from the mouth portion of the container or flying due to the internal pressure of the container, and the liquid in the container is prevented from splattering to the outside of the container.

In the configuration according to claim 2, in the skirt wall, a downwardly open slit is provided. Accordingly, when the plugging-type resin cap is fit into the mouth portion of the container, the diameter of the skirt wall is enlarged to disengage the engagement rib and allow the cap to be easily fit. Even when the diameter of the skirt wall is reduced by firmly tightening the skirt wall with the restraining band, the space in the slit absorbs the diameter reduction to allow the skirt wall to come into close contact with the mouth portion of the container without being distorted and allow the container to be more sufficiently sealed.

In the configuration according to claim 3, in the skirt wall around the tab main body, a tab expansion slit adjacent to the tab main body is provided. As a result, when the operation of lifting up the tab is performed, no deformation is transmitted to the skirt wall in the vicinity of the tab or to the engagement projections to allow the tab to function as a separate body. This prevents the cap from being suddenly detached from the mouth portion of the container before the internal pressure of the container is released and allows the container to be more easily uncapped.

In the configuration according to claim 4, a weakened portion formed thinner is provided in the tab expansion slit. As a result, it is possible to prevent the tab from moving or being deformed at times other than when the container is uncapped. In addition, since the weakened portion is broken as the operation of lifting up the tab proceeds, no load is placed on the restraining band which is in close contact with the skirt wall or the engagement projections. This allows only the tab to be lifted up without interrupting the tightening by the restraining band.

In the configuration according to claim 5, an upper end of the tab main body is provided with a contact sub-tab formed to extend upward. As a result, when the tab is lifted up, the contact sub-tab comes into contact with the upper end portion of the skirt wall. Consequently, the movement of the tab becomes a rotating operation around the upper end portion of the skirt wall. This allows the uplifting of the restraining band and the removal of the plugging-type resin cap to be reliably performed.

In the configuration according to claim 6, on a lower surface of the cap top surface, a ring-shaped inner ring is formed and, in an outer side surface of the inner ring, a recessed exhaust vent opened radially outward from the outer side surface of the inner ring is provided. As a result, when the tab is lifted up, the internal pressure of the container can foe promptly vented to atmosphere using a portion in the vicinity of the tab where the adhesion force between the plugging-type resin cap and the container mouth portion is weakened and the exhaust vent as a flow path.

In the configuration according to claim 7, the joint is formed further toward a radially external side than the stoppers. As a result, it is possible to adjust the lag between the time when the tab is lifted up and the time when the tab comes into contact with the joint. In addition, since the joint does not reach the space above the top surface of the cap, the operation of performing printing on the top surface of the cap is not interrupted.

In the configuration according to claim 8, the engagement projections and the stoppers are formed in wedge shapes, which are interengaged with each other. As a result, when the engagement projections and the stoppers are fit with each other and the skirt wall is tightened with the restraining band, even though a repulsive force in a direction which widens the restraining band is received from the skirt wall, the inter fitting between the engagement projections and the stoppers is not loosened, whereby the restraining band can retain a sufficient tightening force.

In the configuration according to claim 9, the engagement projections are provided below the tab main body. This can prevent the tab main body from interfering with the interfitting between the engagement projections and the stoppers and allow the two engagement projections to extend under the tab main body and be integrally formed. Accordingly, it is possible to allow the restraining band to more reliably retain a sufficient tightening force against the repulsive force in the direction which widens the restraining band received from the skirt wall when there is interfitting between the engagement projections and the stoppers.

In the configuration according to claim 10, the restraining band is provided ever the skirt wall via a thinner portion. As a result, even when the restraining band is taken out of the skirt wall at the time of uncapping, the restraining band is not detached from the skirt wall so that inconvenience at the time of disposal is not increased.

In the configuration according to claim 11, the restraining band is independently provided to be separate from the cap top surface and the skirt wall. Accordingly, by using a material different from that of each of the cap top surface and the skirt wall for the restraining band and appropriately combining the materials, it is possible to give appropriate tightening strengths against various pressures in the container and allow the container to foe sufficiently sealed.

In the configuration according to claim 12, at a lower end of the skirt wall, a flange formed to extend radially outward is provided. As a result, the lower end of the restraining band comes into contact with the flange. This prevents the restraining band from being excessively lowered relative to the skirt wall and allows the restraining band to reliably tighten the skirt wall.

In the configuration according to claim 13, the restraining band is formed of a material different from that of each of the cap top surface and the skirt wall. As a result, even for a product in which the container contains a highly carbonated beverage or the like and has an extremely high internal pressure, by changing the material of only the restraining band to a material which is hard and less likely to stretch, it is possible to design the restraining band having a strength which allows the restraining band to sufficiently tighten the skirt wall, while allowing the cap top surface and the skirt wall to retain moldability and fittability into the mouth portion of the container.

In the configuration according to claim 14, a month portion of a container has an engagement ridge projecting outward from an outer side surface thereof, and the plugging-type resin cap is fit into the mouth portion of the container at a position where the engagement rib has moved down over and beyond the engagement ridge. As a result, even when the internal pressure of the container is high, the skirt wall is tightened by the restraining band and, even when a force in a direction which detaches the plugging-type resin cap is generated, it is possible to prevent an enlargement of the diameter of the skirt wall which allows the engagement rib to move up over and beyond the engagement ridge.

Reference Signs List

| | |
|---|---|
| 100, 200, 300 | Plugging-type resin cap |
| 301 | Cap main body |
| 110, 210, 310 | Cap top surface |
| 111, 211, 311 | Inner ring |
| 112, 212, 312 | Exhaust vent |
| 113, 213, 313 | Outer ring |
| 120, 220, 320 | Skirt wall |
| 121, 221, 321 | Skirt portion |
| 122, 222, 322 | Engagement rib |
| 123, 223, 323 | Slit |
| 124, 224, 324 | Tab expansion slit |
| 125, 225, 325 | Weakened portion |
| 126, 226 | Outer-side-surface recessed portion |
| 127, 227 | Connecting base portion |
| 228 | Contact projecting portion |
| 130, 230 | Restraining band |
| 131, 231 | Restraining portion |
| 132, 232 | Stopper |
| 133, 233 | Upwardly projecting portion |
| 134, 234 | Projecting piece |
| 135, 235 | Joint |
| 136, 236 | Inner-side-surface recessed portion |
| 140, 240 | Tab |
| 141, 241 | Contact sub-tab |
| 142, 242 | Tab main body |
| 143, 243 | Hold portion |
| 150, 250 | Thinner inversion wall (thinner portion) |
| 151, 251 | Engagement projection |
| 152 | Bridge |
| 326 | Contact projecting portion |
| 327 | Flange |
| 328 | Connecting base portion |
| 330 | Tab |
| 331 | Contact sub-tab |
| 332 | Tab main body |
| 333 | Hold portion |
| 340 | Engagement Projection |
| 400 | Restraining band |
| 401 | Restraining portion |
| 402 | Stopper |
| 403 | Upwardly projecting portion |
| 404 | Projecting piece |
| 405 | Joint |
| B | Container mouth portion |
| T | Engagement ridge |

DESCRIPTION OF EMBODIMENTS

Embodiment 1

The following will describe a plugging-type resin cap 100 according to a first embodiment of the present invention on the basis of the drawings.

Figure 1:
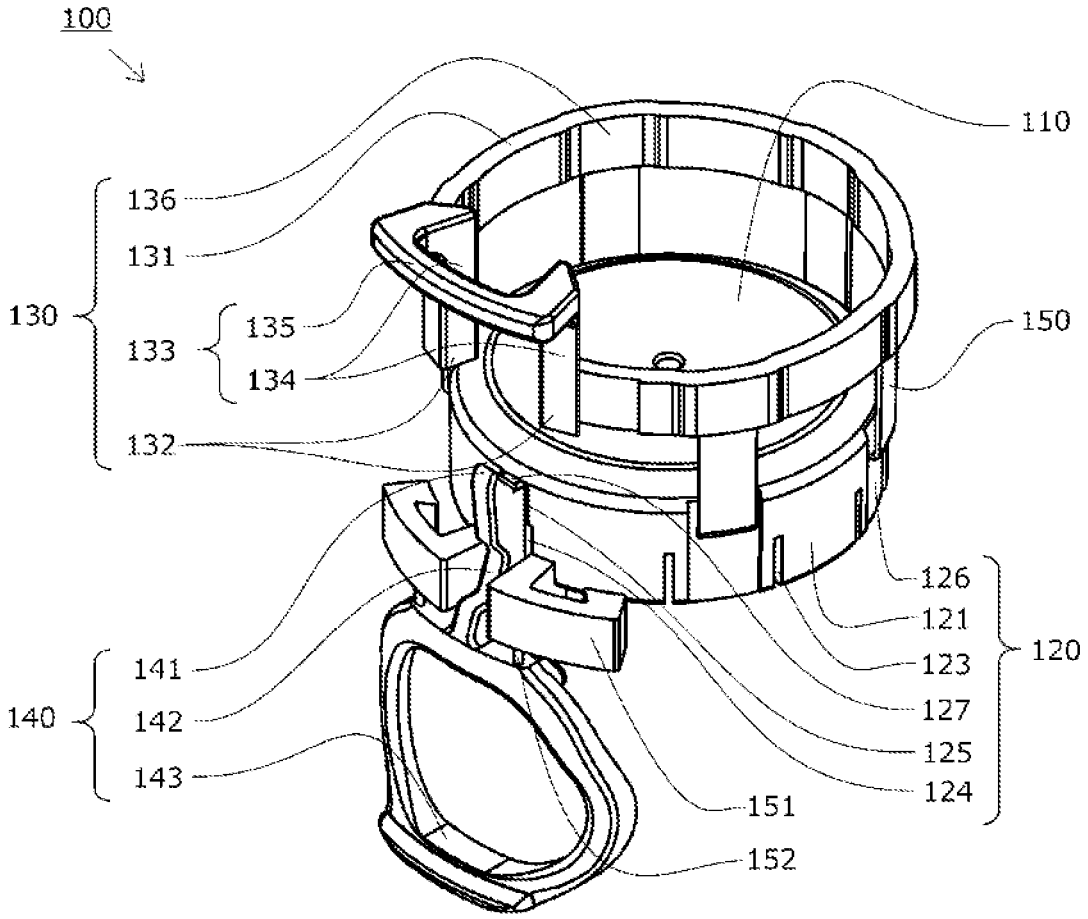
FIG. 1 is a perspective view of a plugging-type resin cap according to a first embodiment of the present invention.
Figure 2:
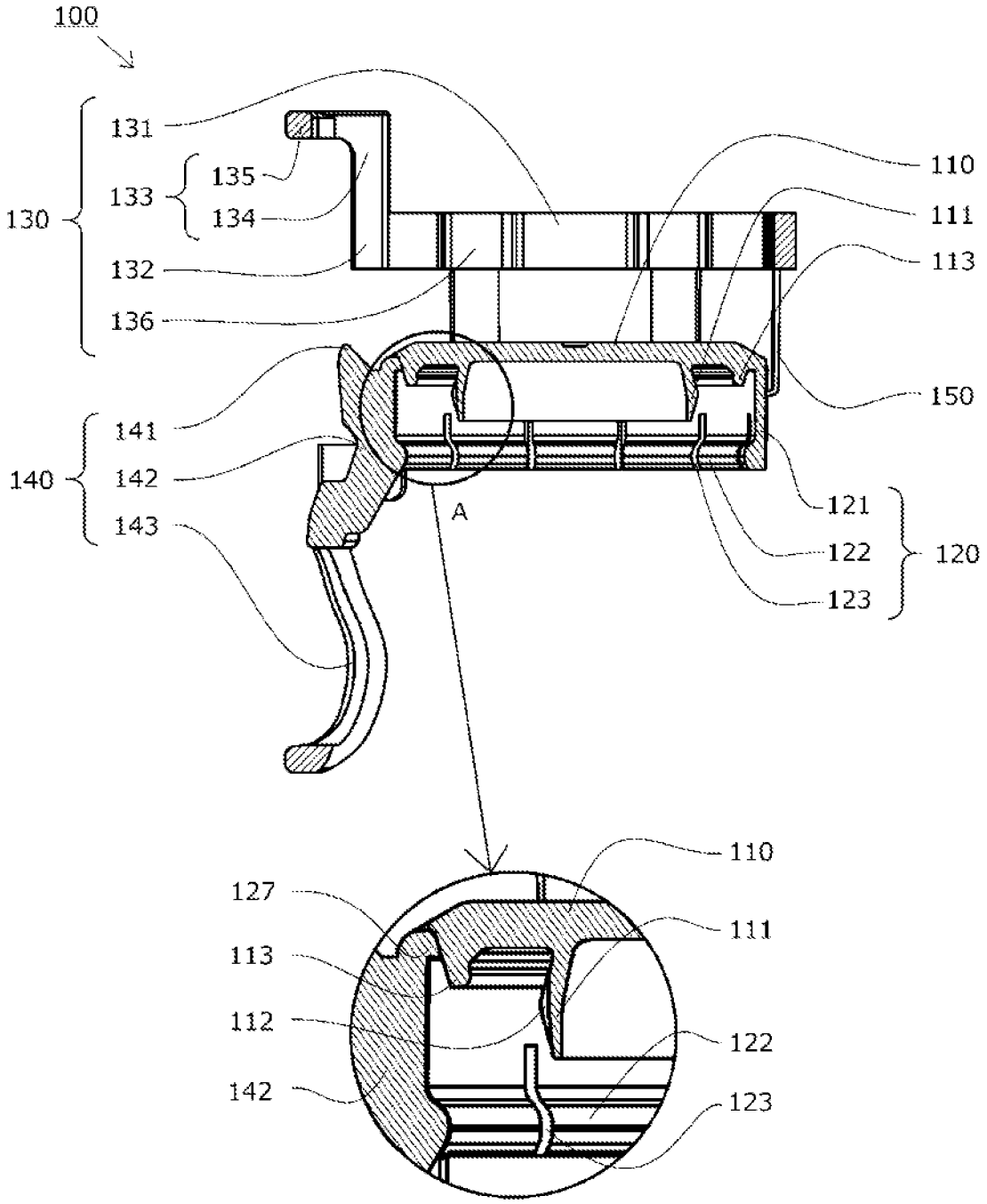
FIG. 2 is a cross-sectional view of the plugging-type resin cap according to the first embodiment of the present invention.

The plugging-type resin cap 100 is placed over a container month portion B of a jar, a plastic bottle, or the like and strongly pressed down to be attached to the container mouth portion B and cap the container. As shown in FIGS. 1 and 2, the plugging-type resin cap 100 includes a cap top surface 110, a skirt wall 120 extending vertically downward from the circumferential edge of the cap top surface 110, a restraining band 130 provided over the skirt wall 120 via thinner inversion walls 150 each formed as a thinner portion, and a tab 140 formed over a portion of the outer side surface of the skirt wall 120.

As shown in the enlarged view of FIG. 2, the cap top surface 110 has an inner ring 111 and an outer ring 113. In the outer side surface of the inner ring 111, an exhaust vent 112 having a recessed groove shape extending in an axial direction is provided in the vicinity of the tab 140.

As shown in FIGS. 1 and 2, the skirt wall 120 is provided with a skirt portion 121, an engagement rib 122 formed at the lower end of the inner side surface of the skirt portion 121, downwardly open slits 123 disposed on the circumference of the skirt portion 121, a tab expansion slit 124 which opens a part of a portion connecting the skirt portion 121 and the tab 140, a weakened portion 125 formed thinner in the tab expansion slit 124, and outer-side-surface recessed portions 126 formed to extend from the upper end of the outer side surface of the skirt portion 121 connected to the thinner inversion walls 150 to the lower end thereof.

The restraining band 130 is provided with a restraining portion 131 formed in an arcuate shape, a pair of stoppers 132 formed radially externally of the both ends of the restraining portion 131, an upwardly projecting portion 133 formed to extend upward from the upper portions of the stoppers 132, and inner-side-surface recessed portions 136 formed to extend from the upper end of the inner side surface of the restraining portion 131 connected to the thinner inversion walls 150 to the lower end thereof. The upwardly projecting portion 133 includes a pair of projecting pieces 134 extending continuously upward from the upper portions of the stoppers 132 and a joint 135 joining the pair of projecting pieces 134 together. The joint 135 in the present embodiment has a shape in which portions protruding outward from the upper ends of the individual projecting pieces 134 are joined together into a circumferentially arcuate shape.

The tab 140 is provided with a tab main body 142 connected to the skirt portion 121 via a connecting base portion 127 and the weakened portion 125, a contact sub-tab 141 formed to project upward from the upper portion of the tab main body 142, and a ring-shaped hold portion 143 formed to extend downward from the lower portion of the tab main body 142. At the inner side surface of the tab main body 142, a projecting portion similar to the engagement rib 122 is formed while, in the outer side surface of the tab main body 142, a recessed portion is formed.

On both circumferentially lateral sides of the tab 140, a pair of engagement projections 151 are disposed at the lower portion of the outer side surface of the skirt portion 121. The lower portions of the engagement projections 151 are connected to the upper portion of the hold portion 143 via bridges 152.

The engagement projections 151 in the present embodiment are shaped to extend outward from the outer side surface of the skirt portion 121 and extend in a circumferentially arcuate shape in a direction away from the tab 140. In the tip portions of the engagement projections 151, wedge-shaped recessed portions which interfit with the stoppers 132 are formed.

The tab main body 142, which is separated from the engagement projections 151 by the tab expansion slit 124 and is not directly connected thereto, is allowed to independently function as a separate body.

Next, a description will be given of the procedure of capping and uncapping the container mouth portion B using the plugging-type resin cap 100 in the present embodiment. Note that, of the container to foe capped and uncapped, only the container mouth portion B is depicted.

First, the capping procedure will be described. As shown in PROCEDURE 1 in FIG. 3, the plugging-type resin cap 100 is disposed immediately above the container mouth portion B. When the cap top surface 110 is pushed down into the container mouth portion B from thereabove, the plugging-type resin cap covers the container mouth portion B. When the plugging-type resin cap 100 is further pushed down in the container mouth portion B, the engagement rib 122 moves down over and beyond a ring-shaped engagement ridge T provided along the outer side surface of the container mouth portion B so that the plugging-type resin cap 100 fits deeply into the container mouth portion B. At this time, the inner ring 111 comes into close contact with the inner side surface of the container mouth portion B, while the outer ring 113 comes into close contact with the outer side surface of the container mouth portion B.

Note that, since the slits 123 are provided, the diameter of the skirt portion 121 is easily enlarged to allow the engagement rib 122 to easily move down over and beyond the engagement ridge T. Consequently, the force which causes the plugging-type resin cap 100 to fit into the container mouth portion B can be held small.

Figure 3:
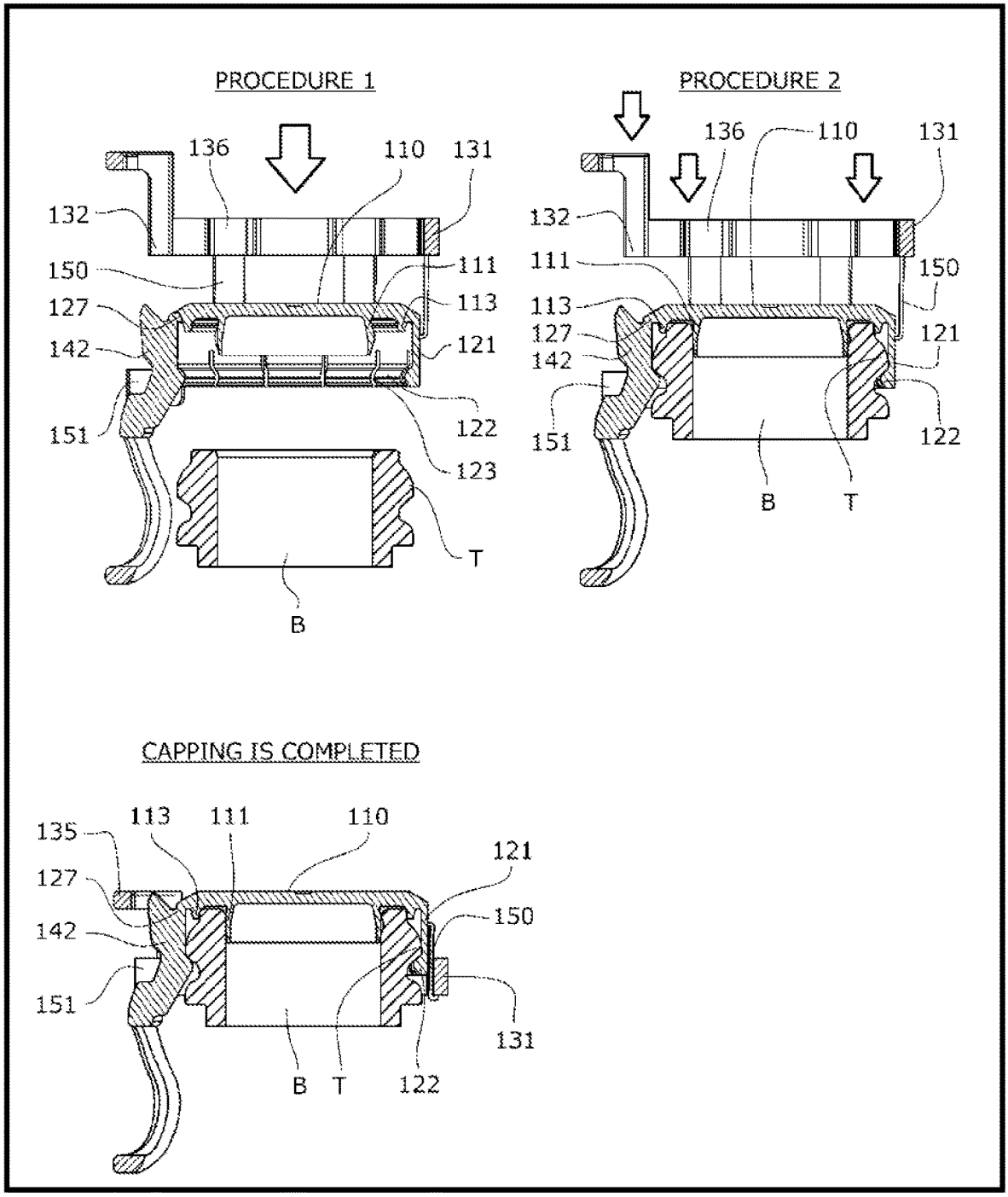
FIG. 3 shows the procedure of capping the plugging-type resin cap according to the first embodiment of the present invention.

As subsequently shown in PROCEDURE 2 in FIG. 3, when the restraining band 130 of the plugging-type resin cap 100 is pressed down, the restraining band 130 moves along the outer circumference of the skirt portion 121. At this time, the thinner inversion walls 150 are folded in association with the movement of the restraining band 130 to be interposed between the outer side surface of the skirt portion 121 and the inner side surface of the restraining portion 131. By further pushing down the restraining band 130 and causing the stoppers 132 and the engagement projections 151 to fit with each other, the restraining portion 131 is fixed in such a manner as to tighten the outer side surface of the skirt portion 121. As a result, the engagement rib 122 firmly tightens the container mouth portion B to reduce the likelihood of detachment of the plugging-type resin cap 100 from the container mouth portion B and allow for the adhesion force between the outer ring 113 and the container mouth portion B to be enhanced.

Note that, since the slits 123 are provided, the diameter of the skirt portion 121 is easily reduced. This allows the stoppers 132 and the engagement projections 151 to fit with each other even when the distance between the pair of engagement projections 151 or the circumferential length of the restraining portion 131 is reduced. This can further enhance the tightening force applied by the restraining portion 131 to the skirt portion 121 to further reduce the likelihood of detachment of the plugging-type resin cap 100 from the container mouth portion B and can further enhance the adhesion force between the outer ring 113 and the container mouth portion B.

Since the spaces formed by the outer-side-surface recessed portions 126 of the skirt portion 121 and the inner-side-surface recessed portions 136 of the restraining portion 131 absorb the increased thicknesses of the folded thinner inversion walls 150, the restraining portion 131 comes into surface contact with the outer side surface of the plugging-type resin cap 100 to be able to give an equal tightening force to the skirt portion 121.

By the foregoing procedure, the plugging-type resin cap 100 firmly fits into the container mouth portion B, and the capping of the container is completed in the state where a high sealing force is retained.

Next, the uncapping procedure will be described. As shown in PROCEDURE 1 in FIG. 4, the hold portion 143 is pulled up to break the bridges 152 and remove the connection between the engagement projections 151 and the hold portion 143. Then, the weakened portion 125 is torn and, simultaneously with the operation of pulling up the hold portion 143, the tab 140 is lifted up using the connecting base 127 between the tab 140 and the cap top surface 110 as a rotation center. At this time, the tab 140 does not come into contact with the restraining band 130 so that the position of the restraining band 130 remains unchanged and the tightening force of the plugging-type resin cap 100 remains strong. However, as only the tab main body 142 moves further away from the container mouth portion, the connecting base portion 127 between the tab 140 and the cap top surface 110 is slightly distorted to reduce the adhesion force between the inner ring 111 and the outer ring 113 in the vicinity of the tab 140. In addition, since the exhaust vent 112 is provided in the inner ring 111 in the vicinity of the tab 140, when the pressure in the container is positive, a minute flow path is formed in the vicinity of the tab 140 where the adhesion force is reduced. This allows the internal pressure of the container to be released without entailing detachment of the plugging-type resin cap 100.

Figure 4:
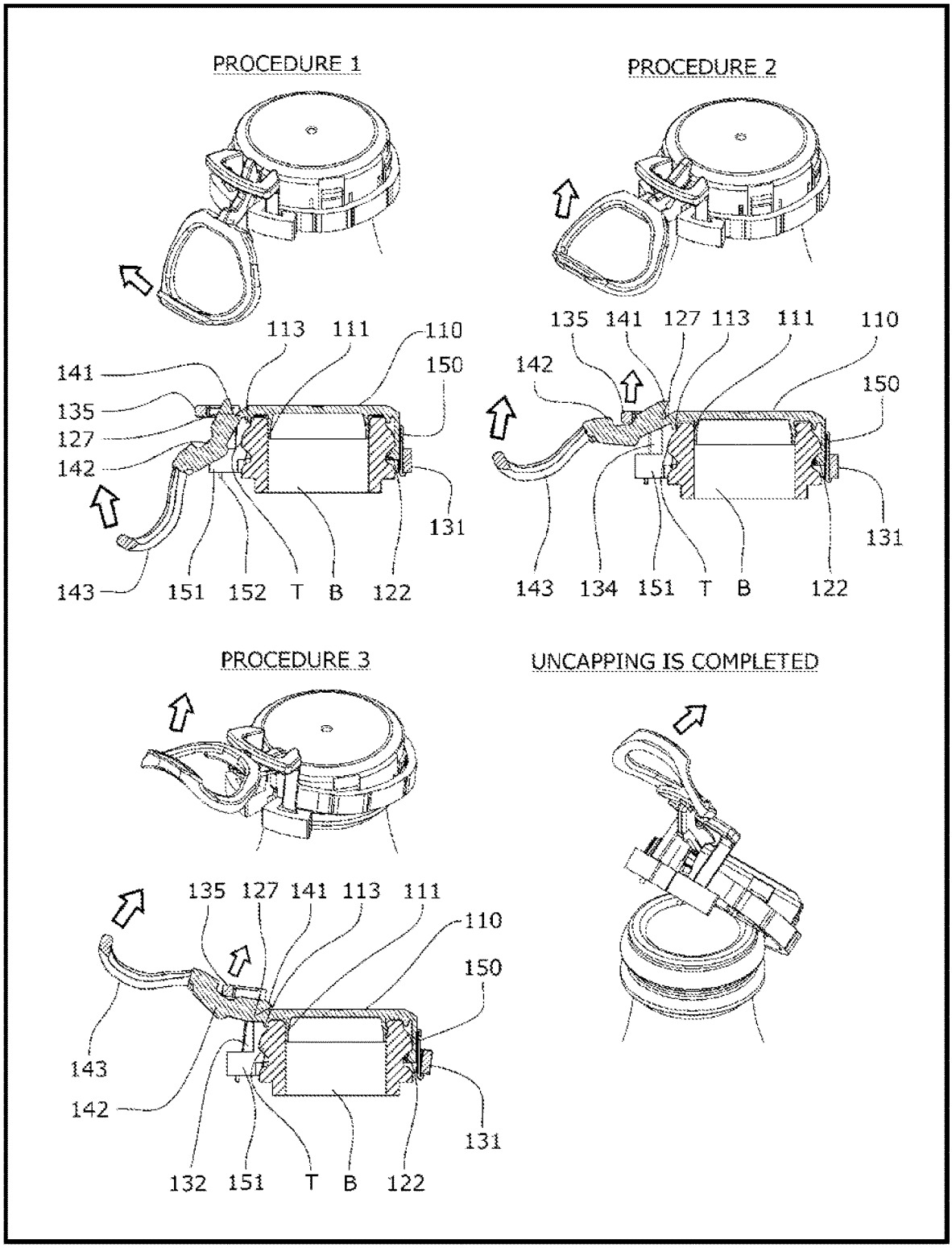
FIG. 4 shows the procedure of uncapping the plugging-type resin cap according to the first embodiment of the present invention.

When the hold portion 143 is further pulled up, as shown in PROCEDURE 2 in FIG. 4, the outer surface of the tab main body 142 comes into first contact with the lower surface of the joint 135 of the upwardly projecting portion 133. As the joint 135 is lifted up in association with the operation of pulling up the hold portion 143, the restraining band 130 is gradually lifted up.

When the restraining band 130 continues to be lifted up together with the hold portion 143, as shown in PROCEDURE 3 in FIG. 4, the stoppers 132 are detached from the engagement projections 151. This removes the circumferential tightening of the skirt portion 121 by the restraining portion 131. In addition, since the contact sub-tab 141 comes into contact with the cap top surface 110, by further pulling up the hold portion 143, the plugging-type resin cap 100 is gradually detached from the container mouth portion B in such a manner as to be peeled up from around the tab 140, so that the uncapping of the container is completed.

In the description of the following embodiments given below, the same portions as in the first embodiment are omitted.

Embodiment 2

Figure 5:
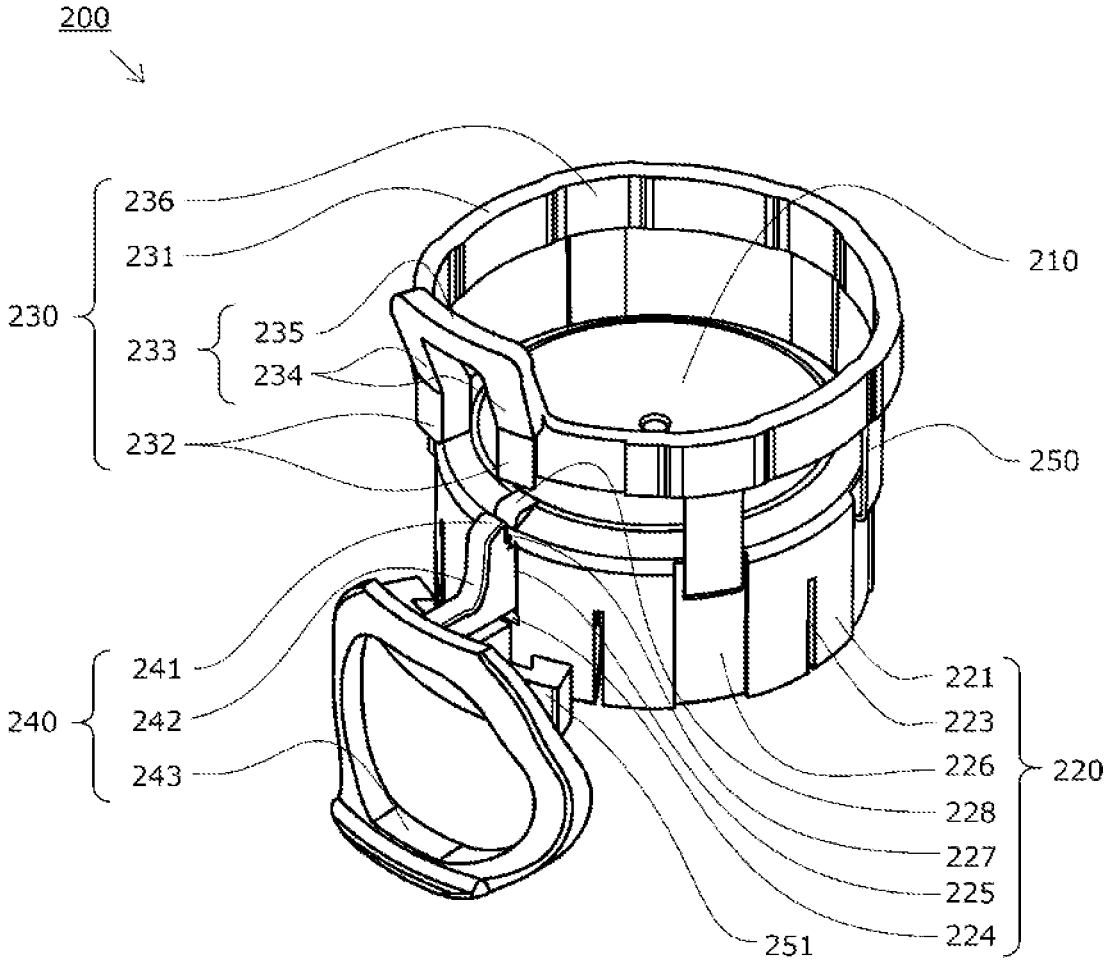
FIG. 5 is a perspective view of a plugging-type resin cap in a second embodiment of the present invention.
Figure 6:
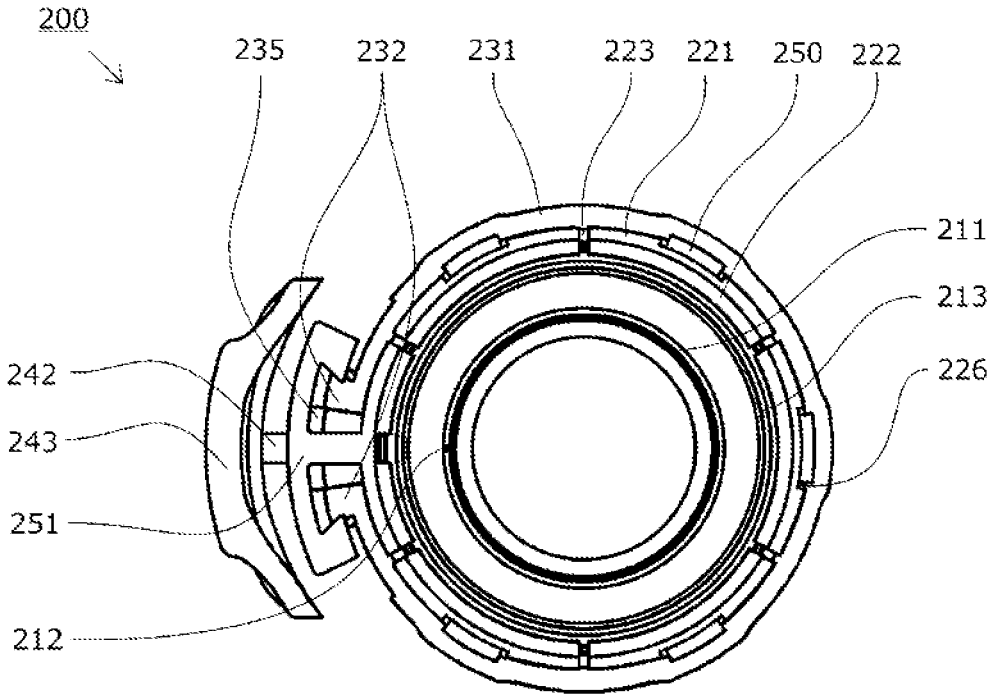
FIG. 6 is a bottom view of the plugging type resin cap in the second embodiment of the present invention.
Figure 7:
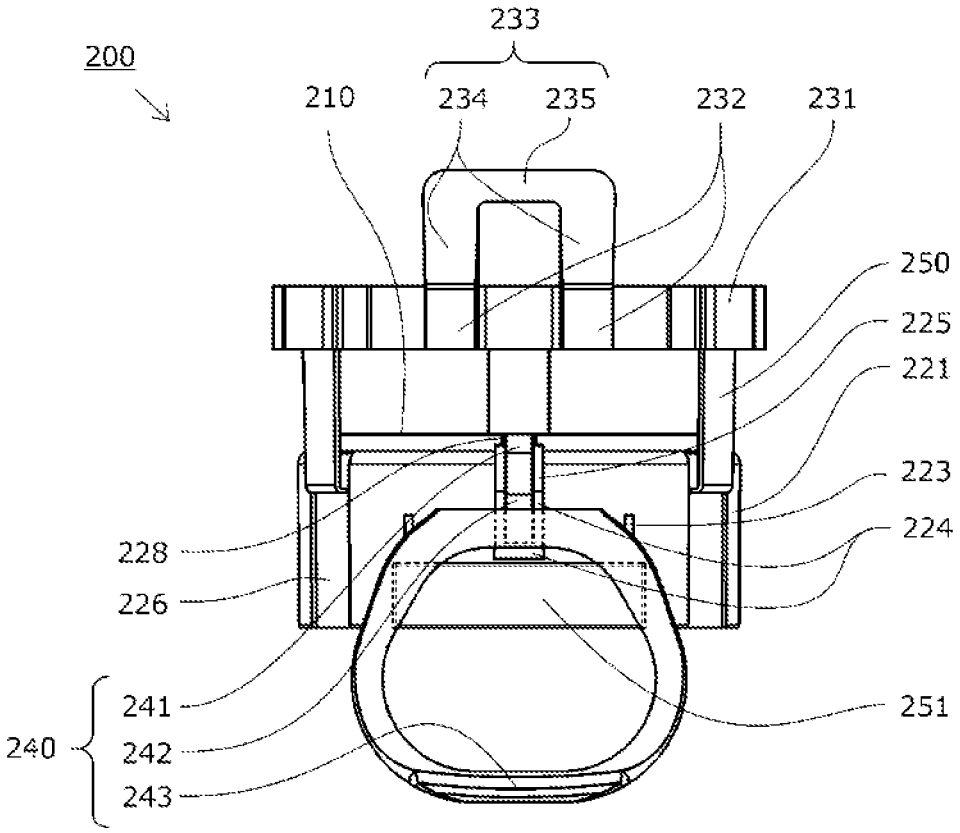
FIG. 7 is a front view of the plugging-type resin cap in the second embodiment of the present invention.

As shown in FIGS. 5 to 7, a plugging-type resin cap according to the second embodiment of the present invention is shaped such that a tab main body 242 extends downward and protrudes outward. Under the tab main body 242, left and right engagement projections 251 are integrally formed. Accordingly, when stoppers 232 of a restraining band 230 in which a restraining portion 231 is formed to have a shorter circumferential length are fit into the engagement projections 251, the left and right engagement projections 251 allow the restraining band 230 to more reliably retain a sufficient tightening force against a repulsive force in a direction which widens the restraining band 230 received from the skirt wall 220.

Since a tab expansion slit 224 is subjacent to the side surface of the lower portion of the tab main body 242, there is no direct contact between the tab main body 242 and the engagement projections 251. As a result, in the same manner as in Embodiment 1, the tab main body 242, which is separated from the engagement projections 251 and are not directly connected thereto, is allowed to independently function as a separate body.

Accordingly, even when a tab 240 is operated, there is no such situation where, the engagement projections 251 are distorted thereby, the interfitting between the stoppers 232 and the engagement projections 251 is loosened, and the restraining band 230 suddenly comes off.

In addition, at the portion of a cap top surface 210 which is adjacent to the tab 240, a contact projecting portion 228 is provided. As a result, during the expansion of the tab 240, a contact sub-tab 241 comes into contact with the contact projecting portion 228, and a pivot point during the expansion of the tab 240 shifts before the contact sub-tab 241 comes into direct contact with the cap top surface 210 to allow the tab 240 to be more easily lifted up.

In the present embodiment, an upwardly projecting portion 233 includes projecting pieces 234 slightly inclined outward and extending upward and a joint 235 joining the respective tips of the projecting pieces 234 together.

Embodiment 3

Next, a description will be given of a plugging-type resin cap 300 according to a third embodiment of the present invention.

Figure 8:
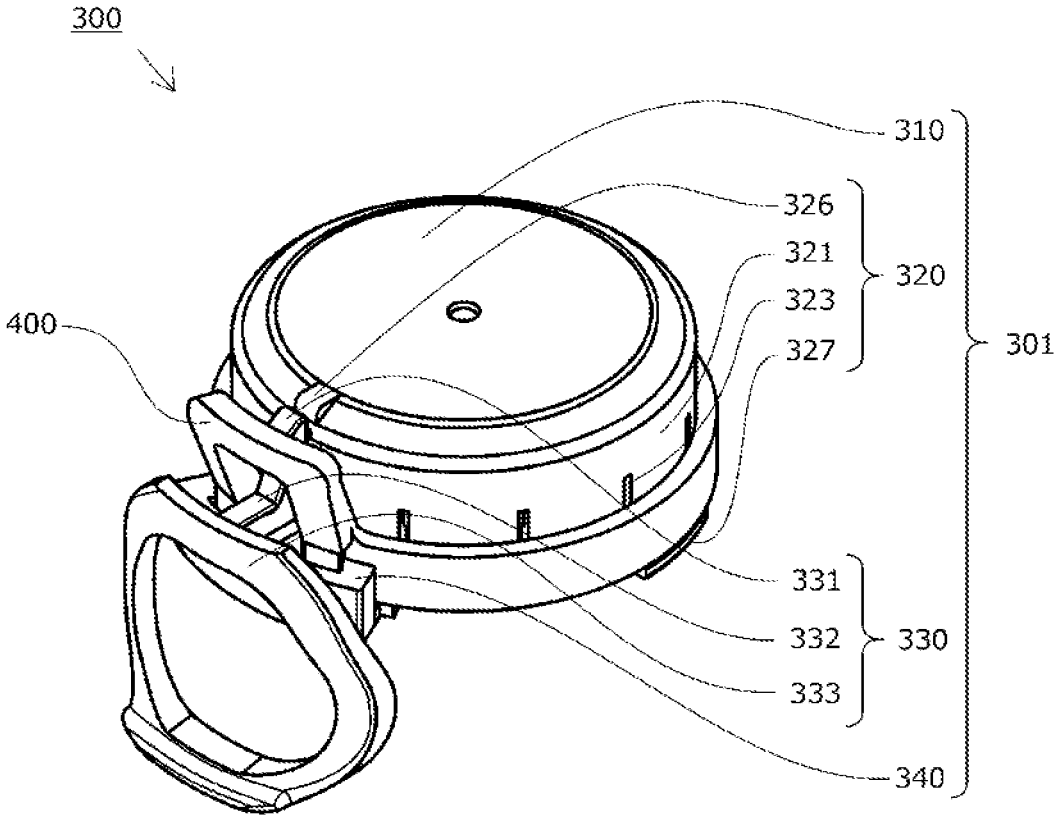
FIG. 8 is a perspective view of a plugging-type resin cap according to a third embodiment of the present invention.

A plugging-type resin cap 300 is placed over the container mouth portion B of a jar, a plastic bottle, or the like and forced downward to be attached to the container mouth portion B and cap the container. As shown in FIG. 8, the plugging-type resin cap 300 includes a cap main body 301 and a restraining band 400.

Figure 9:
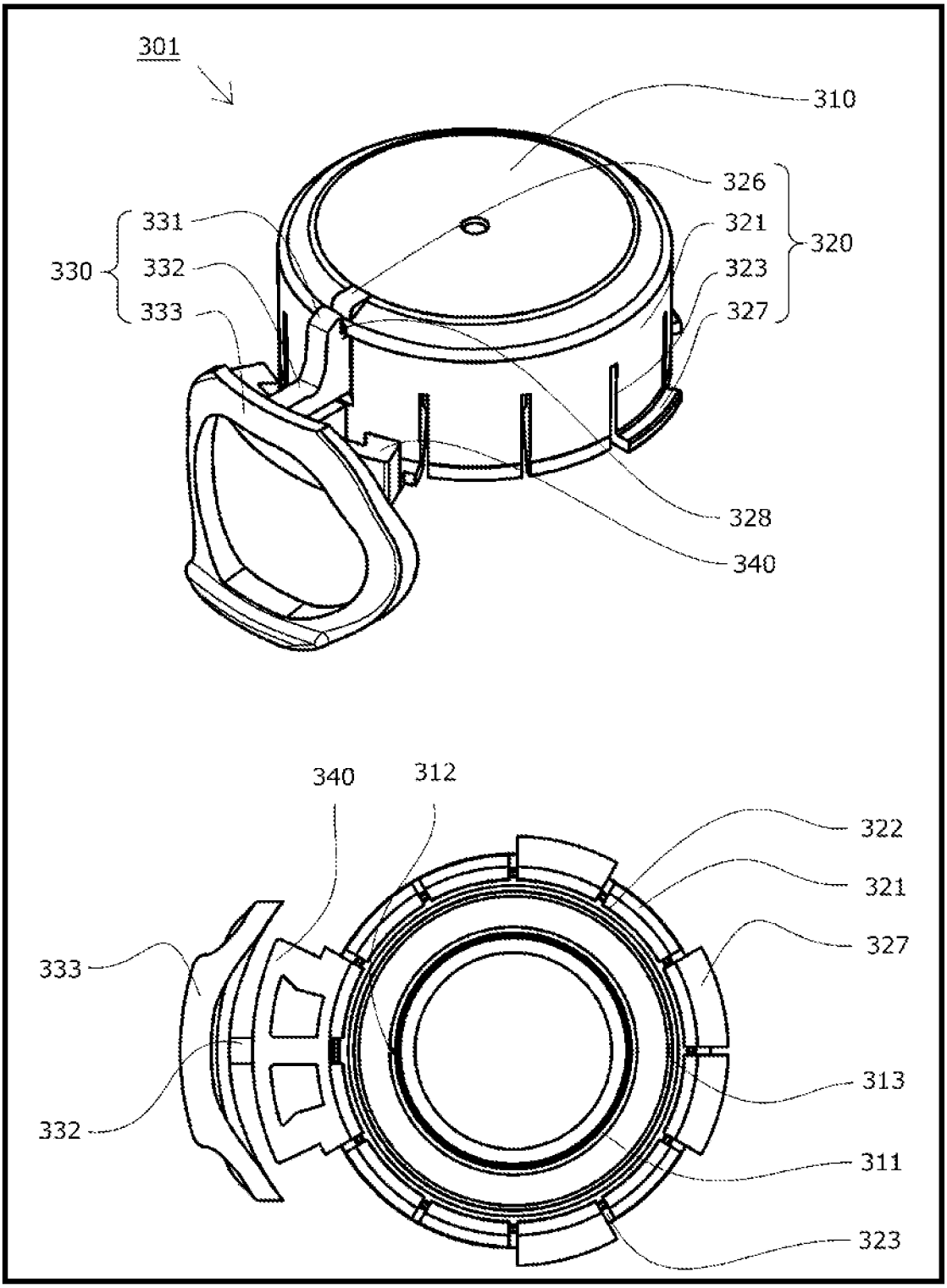
FIG. 9 shows a perspective view and a bottom view of a cap main body according to the third embodiment of the present invention.
Figure 10:
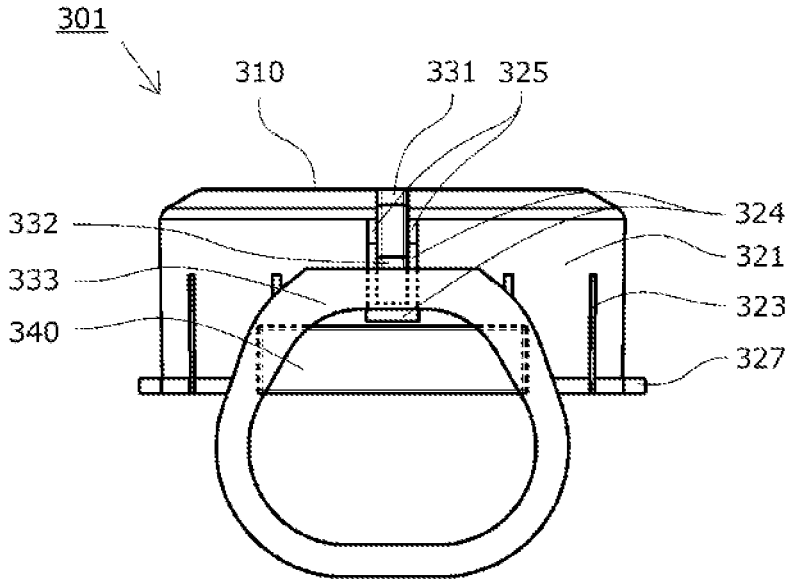
FIG. 10 is a front view of the cap main body according to the third embodiment of the present invention.
Figure 11:
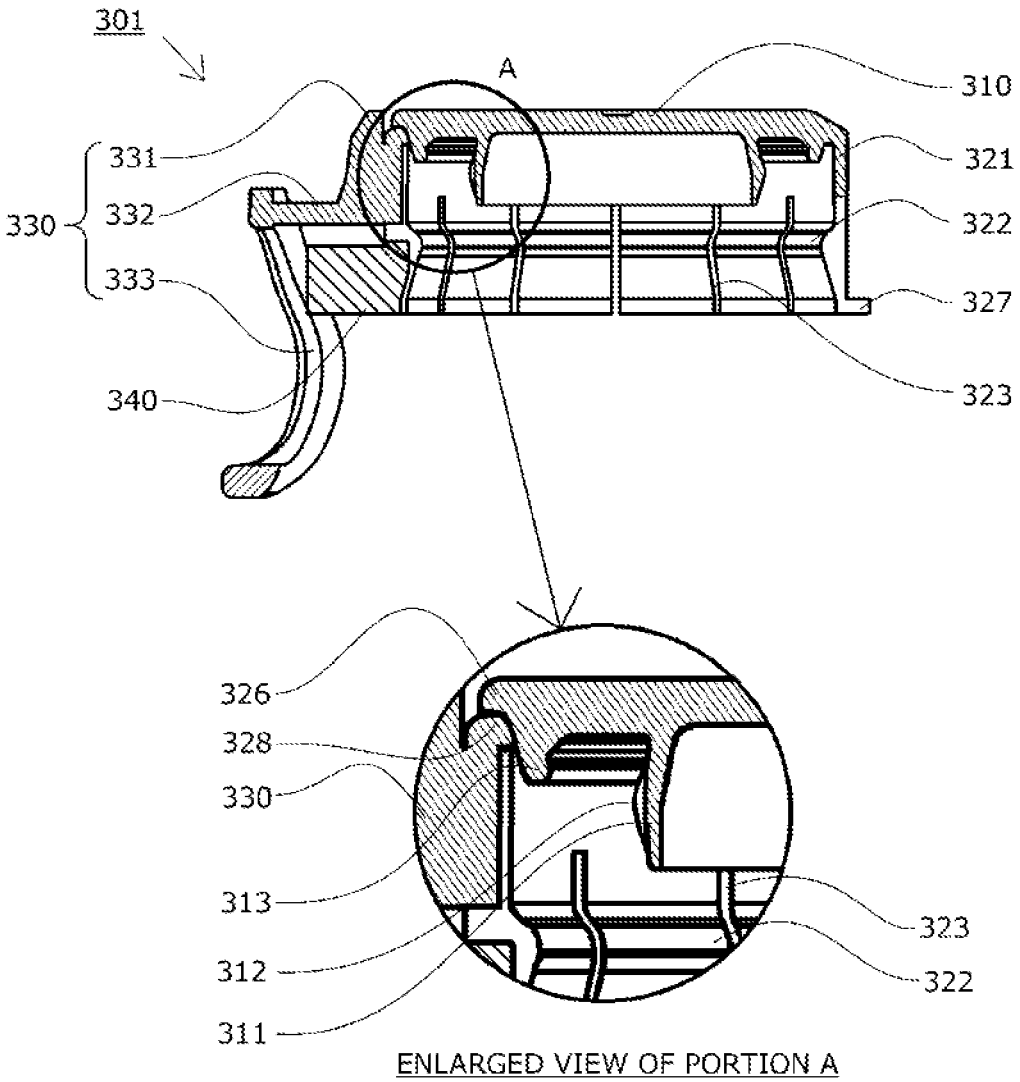
FIG. 11 is a cross-sectional view of the cap main body according to the third embodiment of the present invention.

As shown in FIGS. 9 to 11, the cap main body 301 includes a cap top surface 310, a skirt wall 320 extending vertically downward from the circumferential edge of the cap top surface 310, a tab 330, and engagement projections 340. The cap top surface 310 has an inner ring 311 and an outer ring 313. In the outer side surface of the inner ring 311, an exhaust vent 312 having a recessed groove shape extending in an axial direction is provided in the vicinity of the tab 330.

The skirt wall 320 is provided with a skirt portion 321, an engagement rib 322 formed at the lower end of the inner side surface of the skirt portion 321, downwardly open slits 323 disposed on the circumference of the skirt portion 321, a tab expansion slit 324 formed continuously in a U-shaped shape between the skirt portion 321 and the tab 330, a weakened portion 325 formed thinner in the tab expansion slit 324, and a flange 327 formed to extend radially outward from the lower end of the outer side surface of the skirt portion 321. In the vicinity of the tab 330 at the upper end of the outer side surface of the skirt portion 321, a contact projecting portion 326 is provided.

The tab 330 is provided with a tab main body 332 connected to the skirt portion 321 via a connecting base portion 328 and the weakened portion 325 to extend downward, a contact sub-tab 331 formed to project upward from the upper portion of the tab main body 332, and a ring-shaped hold portion 333 formed to extend downward from the lower portion of the tab main body 332.

Under the tab main body 332, the engagement projections 340 are disposed at the outer side surface of the skirt portion 321. The engagement projections 340 in the present embodiment have a T-shaped shape extending outwardly from the outer side surface of the skirt portion 321 and extending in a circumferentially arcuate shape. In the both end portions of the engagement projections 340, wedge-shaped recessed portions are formed, while the lower portions of the circumferential both ends of the engagement projections 340 are connected to the outer side surface of the skirt portion 321.

The tab main body 332, which is separated from the engagement projections 340 by the tab expansion slit 324 and is not directly connected thereto, is allowed to independently function as a seperate body.

Figure 12:
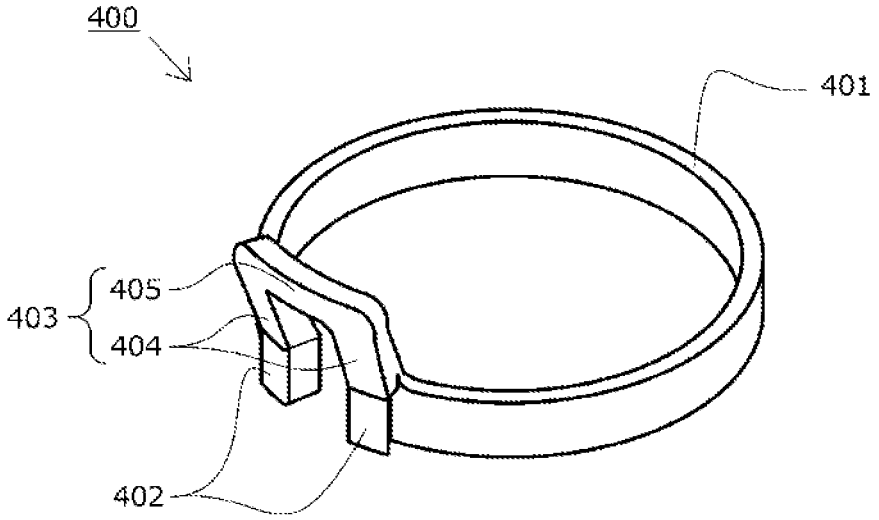
FIG. 12 is a perspective view of a restraining band according to the third embodiment of the present invention.

As shown in FIG. 12, the restraining band 400 is configured as an independent member separate from the cap main body 301 and provided with a restraining portion 401 formed in an arcuate shape, a pair of stoppers 402 formed radially externally of the both ends of the restraining portion 401, and an upwardly projecting portion 403 formed to extend upward from the upper portions of the stoppers 402.

The upwardly projecting portion 403 includes a pair of projecting pieces 404 slightly inclined outward from the upper portions of the stoppers 402 and continuously extending upward and a joint 405 joining the respective tips of the pair of projecting pieces 404 together.

Next, a description will foe given of the procedure of capping and uncapping the container mouth portion B using the plugging-type resin cap 300 in the present embodiment. Note that, of the container to be capped and uncapped, only the container mouth portion B is depicted.

First, the capping procedure will be described. As shown in PROCEDURE 1 in FIG. 13, the cap main body 301 is disposed immediately above the container mouth portion B. When the cap top surface 310 is pushed down into the container mouth portion 8 from above, the cap main body 301 covers the container mouth portion B. When the cap main body 301 is further pressed down in the container mouth portion B, the engagement rib 322 moves down over and beyond the ring-shaped engagement ridge T provided along the outer side surface of the container mouth portion B so that the cap main body 301 fits deeply into the container mouth portion B. At this time, the inner ring 311 comes into close contact with the inner side surface of the container mouth portion B, while the outer ring 313 comes into close contact with the outer side surface of the container mouth portion B.

Mote that, since the slits 323 are provided, the diameter of the skirt portion 321 is easily enlarged to allow the engagement rib 322 to easily move down over and beyond the engagement ridge T. Consequently, the force which causes the cap main body 301 to fit into the container mouth portion B can be held small.

Figure 13:
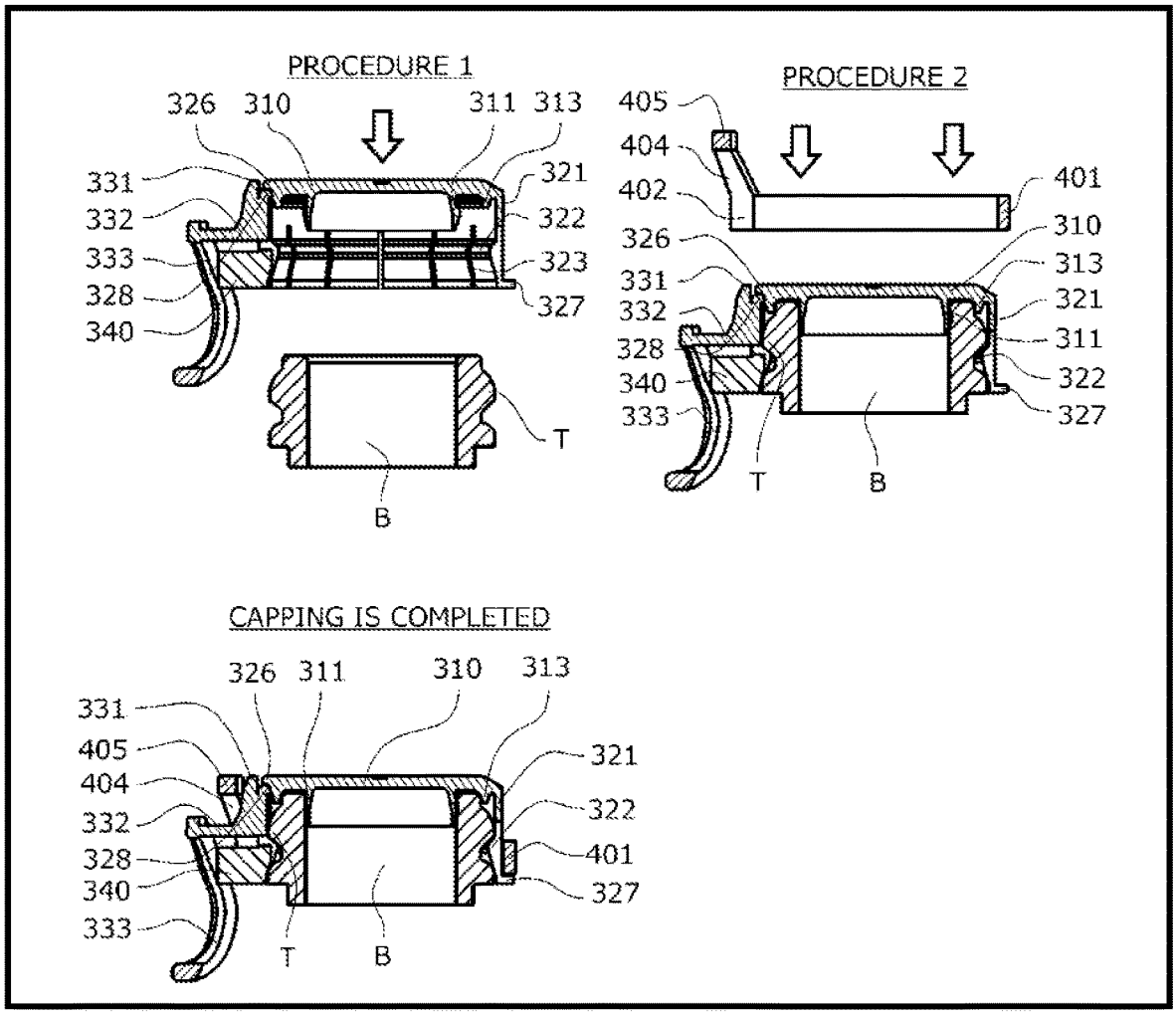
FIG. 13 shows the procedure of capping the plugging-type resin cap according to the third embodiment of the present invention.

Next, as shown in PROCEDURE 2 in FIG. 13, when the restraining band 400 is placed immediately above the cap main body 301 and pressed down or the restraining band 400 held at an appropriate fit position is pressed down, the restraining band 400 moves along the outer circumference of the skirt portion 321. By causing the stoppers 402 and the engagement projections 340 which are formed in interfitting wedge shapes to fit with each other, the restraining portion 401 is fixed in such a manner as to tighten the outer side surface of the skirt portion 321. As a result, the engagement rib 322 firmly tightens the container mouth portion B to reduce the likelihood of detachment of the cap main body 301 from the container mouth portion B and allow for the adhesion force between the outer ring 313 and the container mouth portion B to be enhanced. In addition, since the flange 327 is formed to extend radially outward from the lower end of the outer side surface of the skirt portion 321, the restraining band 400 as the independent member which is pressed down comes into contact with the flange 327. This can prevent the restraining band 400 from being excessively pressed down.

Moreover, since the lower portions of the both ends of the engagement projections 340 are connected to the outer side surface of the skirt portion 321, the engagement projections 340 can hold the restraining band 400 at an appropriate fit position, similarly to the flange 327.

Therefore, the foregoing procedure can also be performed in the state where the restraining band 400 is held at an appropriate fit position.

Note that, since the slits 323 are provided, the diameter of the skirt portion 321 is easily reduced. This allows the stoppers 402 and the engagement projections 340 to fit with each other even when the distance between the pair of engagement projections 340 or the circumferential length of the restraining portion 401 is reduced. This can further enhance the tightening force applied by the restraining portion 401 to the skirt portion 321 to further reduce the likelihood of detachment of the cap main body 301 from the container mouth portion B and can further enhance the adhesion force between the outer ring 313 and the container mouth portion B.

In addition, since the middle and both ends of the engagement projections 340 are connected to the skirt portion 321, even when the engagement projections 340 receive a force generated in a direction which enlarges the diameter of the restraining band 400, the engagement projections 340 are distorted only minimally to be able to hold the restraining band 400 without increasing the diameter thereof.

By the foregoing procedure, the plugging-type resin cap 300 firmly fits into the container mouth portion B, and the capping of the container is completed in the state where a high sealing force is maintained.

Next, the uncapping procedure will be described. As shown in PROCEDURE 1 in FIG. 14, the hold portion 333 is pulled up to tear the weakened portion 325 and, simultaneously with the operation of pulling up the hold portion 333, the tab 330 is lifted up using the connecting base 328 between the tab 330 and the cap top surface 310 as a rotation center. At this time, the tab 330 does not come into contact with the restraining band 400 so that the position of the restraining band 400 remains unchanged and the tightening force of the plugging-type resin cap 300 remains strong. However, as only the tab main body 332 moves further away from the container mouth portion B, the connecting base portion 328 between the tab 330 and the cap top surface 310 is slightly distorted to reduce the adhesion force between the inner ring 311 and the outer ring 313 in the vicinity of the tab 330. In addition, since the exhaust vent 312 is provided in the inner ring 311 in the vicinity of the tab 330, when the pressure in the container is positive, a minute flow path is formed in the vicinity of the tab 330 where the adhesion force is reduced. This allows the internal pressure of the container to be released without entailing detachment of the cap main body 301.

Figure 14:
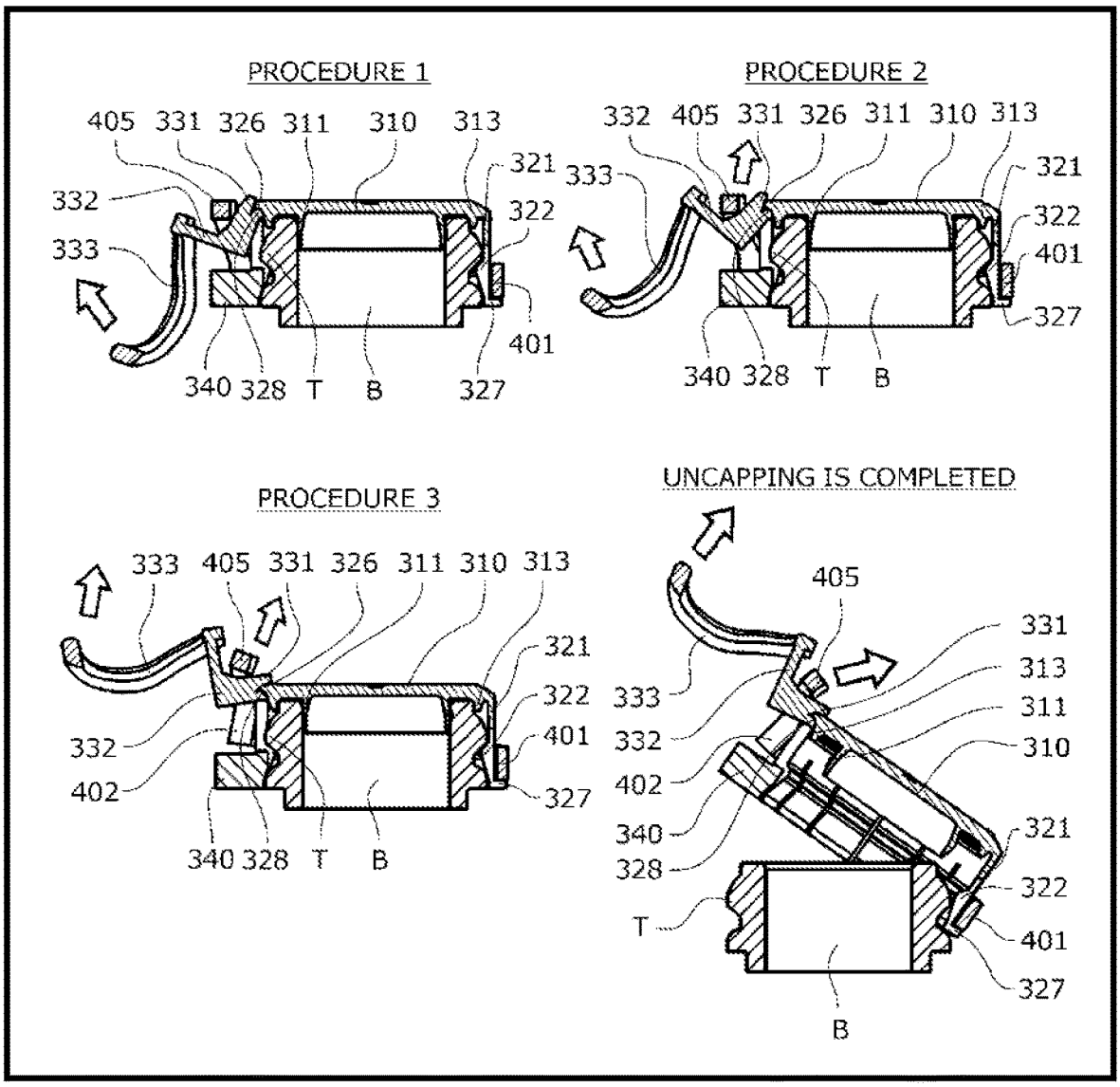
FIG. 14 shows the procedure of uncapping the plugging-type resin cap according to the third embodiment of the present invention.

When the hold portion 333 is further pulled up, as shown in PROCEDURE 2 in FIG. 14, the outer surface of the tab main body 332 comes into first contact with the lower surface of a joint 405 of the upwardly projecting portion 403. As the joint 405 is lifted up in association with the operation of pulling up the hold portion 333, the restraining band 400 is gradually lifted up.

When the restraining band 400 continues to be lifted up together with the hold portion 333, as shown in PROCE- DURE 3 in FIG. 14, the stoppers 402 are detached from the engagement projections 340. This removes the circumferential tightening of the skirt portion 321 by the restraining portion 401. In addition, since the contact sub-tab 331 comes into contact with the contact projecting portion 325, by further pulling up the hold portion 333, the cap main body 301 is gradually detached from the container mouth portion B in such a manner as to be peeled up from around the tab 330, so that the uncapping of the container is completed.

While the embodiments of the present invention have been described in detail, the present invention is not limited to the foregoing embodiments. Various design changes can be made without departing from the present invention described in the scope of claims.

Note that, in the description given above in the first and second embodiments, the restraining band and the skirt wall are assumedly connected via the thinner inversion walls each formed as the thinner portion. However, the relationship between the restraining band and the skirt wall is not limited thereto. For example, the restraining band and the skirt wall may also be formed integrally via a bridge formed as the thinner portion or the like and separated from each other by breaking the bridge at the time of capping. Alternatively, it may also be possible to integrally form the restraining band and the skirt wall via a hinge formed as the thinner portion or the like and move the restraining band to the periphery of the skit wall, while deforming the hinge.

Also, in the description of the embodiments given above, the inner-side-surface recessed portions and the outer-side-surface recessed portions are assumedly provided so as to absorb the thicknesses of the folded thinner inversion walls. However, a method of absorbing the thicknesses of the folded thinner inversion walls is not limited thereto. For example, it may also be possible to form either the inner-side-surface recessed portions or the outer-side-surface recessed portions. Alternatively, it may also be possible to form the thinner inversion walls such that the thicknesses thereof are as small as ignorance and omit the formation of the inner-side-surface recessed portions and the outer-side-surface recessed portions.

Also, in the description given above in the first and second embodiments, the joint is assumedly formed such that the portions thereof protruding outward from the respective upper ends of the projecting pieces are joined together into the circumferentially arcuate shape. However, the position and shape of the joint are not limited thereto as long as a lag can be provided between the time when the tab is lifted up and the time when the tab main body comes into contact with the joint. For example, the joint may also be shaped to linearly join the respective upper ends of the projecting pieces or may also be formed to be inclined so as to directly connect the respective upper ends of the projecting pieces.

Also, in the description given above in each of the embodiments, the slits are assumedly formed to allow an easy reduction in the diameter of the skirt portion. However, a method of reducing the diameter of the skirt portion is not limited thereto. For example, it may also be possible to form a portion of the skirt thinner and impart flexibility to the skirt portion or strongly push down the plugging-type resin cap into the container mouth portion and fit the plugging-type resin cap into the container mouth portion.

Also, in the description given above in each of the embodiments, the inner ring and the outer ring assumedly come into close contact with the container mouth portion to cap the container mouth portion. However, the portion in close contact with the container mouth portion is not limited thereto. For example, it may also be possible to bring the contact surface between the upper end surface of the container and the cap top surface into firm contact with the container mouth portion or provide a ring-shaped ridge along the inner side surface of the skirt portion where no slit is formed and bring the ring-shaped ridge into firm contact with the side surface of the container mouth portion.

Also, in the description given above in each of the embodiments, the hold portion is assumedly formed in the ring shape. However, the shape of the hold portion is not limited thereto. For example, the hold portion may also be formed into a solid fan shape or a hook shape.

Also, in the description given above in each of the embodiments, the tab expansion slit which opens a part of the connecting portion between the skirt portion and the tab is assumedly formed. However, the state where the tab expansion slit is formed is not limited thereto. For example, it may also be possible to omit the tab expansion slit or form the perforated tab expansion slit along the tab main body.

Also, in the description given above in each of the embodiments, the weakened portion formed thinner is assumedly provided in the tab expansion slit. However, the state where the weakened portion is formed is not limited thereto. For example, it may also be possible to omit the weakened portion or form the weakened portion all over the inner surface of the tab expansion slit and provide a notch in the lower end of the weakened portion.

Also, in the description given above in the first and second embodiments, the lower end of the outer side surface of the skirt portion assumedly has no projecting portion other than the engagement projections and, in the description given in the third embodiment, the lower end of the skirt portion assumedly has the flange formed for the alignment of the restraining band. However, the shape of the lower end of the outer side surface of the skirt portion is not limited thereto. For example, the skirt portion may also be formed such that the outer diameter thereof gradually increases with distance from the upper end thereof toward the lower end thereof.

Also, in the description given above in the third embodiment, it is important that the upwardly projecting portion is formed above the stoppers. The upwardly projecting portion may have any shape as long as a lag can be provided between the time when the tab is lifted up and the time when the tab main body comes into contact with the joint. Each of the projecting pieces in the present embodiment has a shape inclined outward and extending upward but, for example, the projecting pieces may also project straight upward. The joint may also have a shape in which outwardly protruding portions are joined together into a circumferentially arcuate shape.

Also, in the description given above in the third embodiment, the contact sub-tab of the tab and the contact projecting portion of the skirt assumedly come into contact with each other to operate as the rotation center of the tab. However, a method of aligning the rotation center of the tab is not limited thereto. For example, the contact projecting portion may also be omitted or the upper end of the outer side surface of the skirt portion may also protrude along the entire circumference.

Also, in the description given above in the third embodiment, it is assumed that, at the time of uncapping, the stoppers of the restraining band are detached from the engagement projections of the cap main body, and the restraining band assumedly comes out of the cap. However, the relationship between the restraining band and the cap main body at the time of uncapping is not limited thereto. For example, it may also be possible to provide the tip of the flange or the tip of the contact sub-tab of the tab with a wall surface or a projecting portion and thus prevent the restraining band from coming off. Alternatively, it may also be possible that the restraining band and the cap main body are configured to be integrally molded by partly connecting the restraining band and the cap main body via a thinner portion and, before use, the thinner portion is detached or folded to be ready for use.

Also, in the description given above in the third embodiment, the exhaust vent is assumedly provided in the inner ring in the vicinity of the tab. However, the number of the exhaust vents and the location of the exhaust vent are not limited thereto. For example, it may also be possible to provide a plurality of the exhaust vents or provide the exhaust vent in the outer ring or in the face of the cap top surface which is in close contact with the container mouth portion.

The invention claimed is:

1. A plugging-type resin cap, comprising:

a cap top surface;

a skirt wall extending vertically downward from a circumferential edge of the cap top surface;

an engagement rib formed along an inner side surface of the skirt wall; and a restraining band tightening the skirt wall, the plugging-type resin cap further comprising:

a tab; and engagement projections, wherein the restraining band has an arcuate restraining portion, stoppers, and an upwardly projecting portion, the stoppers are formed to extend radially outward from circumferential both ends of the restraining portion, the upwardly projecting portion has two projecting pieces formed to extend upward from the circumferential both ends of the restraining portion and a joint joining the two projecting pieces together, the tab has a tab main body formed over an outer side surface of the skirt wall and a hold portion provided under the tab main body, the engagement projections are provided over the outer side surface of the skirt wall to be separate from the tab main body, and the stoppers and the engagement projections are formed to be fit table with each other.

2. The plugging-type resin cap according to claim 1, wherein, in the skirt wall, a downwardly open slit is provided.

3. The plugging-type resin cap according to claim 1, wherein, in the skirt wall around the tab main body, a tab expansion slit adjacent to the tab main body is provided.

4. The plugging-type resin cap according to claim 3, wherein the tab main body is connected to the skirt wall via a weakened portion formed thinner in the tab expansion slit.

5. The plugging-type resin cap according to claim 1, wherein an upper end of the tab main body is provided with a contact sub-tab formed to extend upward.

6. The plugging-type resin cap according to claim 1, wherein, on a lower surface of the cap top surface, a ring-shaped inner ring is formed and, in an outer side surface of the inner ring, a recessed exhaust vent opened radially outward from the outer side surface of the inner ring is provided.

7. The plugging-type resin cap according to claim 1, wherein the joint is formed further toward a radially external side than the stoppers.

8. The plugging-type resin cap according to claim 1, wherein the engagement projections and the stoppers are formed in wedge shapes, which are interengaged with each other.

9. The plugging-type resin cap according to claim 1, wherein the engagement projections are provided below the tab main body.

10. The plugging-type resin cap according to claim 1, wherein the restraining band is provided over the skirt wall via a thinner portion.

11. The plugging-type resin cap according to claim 1, wherein the restraining band is independently provided to be separate from the cap top surface and the skirt wall.

12. The plugging-type resin cap according to claim 11, wherein, at a lower end of the skirt wall, a flange formed to extend radially outward is provided.

13. The plugging-type resin cap according to claim 11, wherein the restraining band is formed of a material different from that of each of the cap top surface and the skirt wall.

14. A container in which the plugging-type resin cap according to claim 1 is fit, wherein a mouth portion of the container has an engagement ridge projecting outward from an outer side surface thereof, and the plugging-type resin cap is fit in the container at a position where the engagement rib has moved down over and beyond the engagement ridge.

* * * * *